United States Patent [19]

Wahlmark

[11] Patent Number: 4,624,175

[45] Date of Patent: Nov. 25, 1986

[54] QUIET HYDRAULIC APPARATUS

[76] Inventor: Gunnar A. Wahlmark, 7636 Edgewood Rd., R.F.D. 3, Dixon, Ill. 61021

[21] Appl. No.: 770,097

[22] Filed: Aug. 28, 1985

[51] Int. Cl.[4] ..... F01B 13/04; F04B 1/30

[52] U.S. Cl. ..... 91/487; 91/499; 91/505; 60/487

[58] Field of Search ..... 60/487, 488, 489; 91/499, 484–488

[56] References Cited

U.S. PATENT DOCUMENTS

| | | | |
|---|---|---|---|
| 1,817,063 | 4/1931 | Carrie | 91/485 |
| 1,817,080 | 8/1931 | Howard | 91/485 |
| 2,844,104 | 7/1958 | Wennberg | 91/485 |
| 2,993,339 | 7/1961 | Timms | 60/487 |
| 3,110,267 | 11/1963 | Vetter | 91/485 |
| 3,137,243 | 6/1964 | Beck et al. | 91/499 |
| 3,168,009 | 2/1965 | Grad | 91/485 |
| 3,194,172 | 7/1965 | Schottler | 91/485 |

FOREIGN PATENT DOCUMENTS

| | | | |
|---|---|---|---|
| 216631 | 6/1924 | United Kingdom | 60/487 |
| 1011532 | 12/1961 | United Kingdom | 60/487 |
| 1023388 | 3/1966 | United Kingdom | 60/487 |
| 1265518 | 3/1972 | United Kingdom | 91/485 |

*Primary Examiner*—William L. Freeh

*Attorney, Agent, or Firm*—Leydig, Voit & Mayer, Ltd.

[57] ABSTRACT

The hydraulic apparatus may either be a quiet hydrostatic drive with an axial piston pump and an axial piston motor or may be a quiet pump unit formed by two axial piston pumps. In either case, the apparatus includes two rotatable cylinder blocks disposed on opposite sides of a rotationally stationary valve block and tied together by a rod which transmits forces between the two cylinder blocks so that any force tending to unseat one cylinder block from the valve block tends to seat the other cylinder block against the valve block. A resiliently yieldable sealing ring on one end portion of the rod defines a pressure chamber which receives oil at working pressure to automatically increase and decrease the axial clearance between the cylinder blocks and the valve block as the working pressure increases and decreases, respectively.

11 Claims, 8 Drawing Figures

QUIET HYDRAULIC APPARATUS

BACKGROUND OF THE INVENTION

This invention relates to hydraulic apparatus and, more particularly, to hydraulic pumps and/or motors of the axial piston type.

An axial piston pump of the type with which the present invention is concerned includes a set of angularly spaced pistons adapted to reciprocate in a rotatable cylinder block. An inclined swash plate is rotated by an input shaft and causes the pistons to reciprocate within the cylinder block. During the intake stroke of each piston, charge oil is delivered to the cylinders under the control of a valve block. The charge oil is pressurized during the power stroke of each piston and is discharged at high pressure through the valve block. The displacement of the pump may be selectively varied by changing the angle of the swash plate.

An axial piston hydraulic motor similarly includes a rotatable cylinder block, a set of angularly spaced pistons adapted to reciprocate in the block and a swash plate connected to the pistons. The pistons are reciprocated as oil is admitted into and exhausted from the cylinders under the control of a valve block, such reciprocation effecting rotation of the swash plate and an output shaft connected to the swash plate.

A hydrostatic drive may be formed by arranging a pump and motor in tandem with their cylinder blocks located on opposite sides of a rotationally stationary valve block. In such an instance, the pump driven by the input shaft pressurizes charge oil and delivers high pressure oil to the motor to drive the output shaft.

Hydraulic apparatus of the foregoing type inherently produces noise. Oil flowing between the cylinder blocks and the valve block for flow into and out of the cylinders causes the cylinder block to pulsate with respect to the valve block. Such pulsations produce noise and reduce the smoothness and efficiency of the apparatus.

SUMMARY OF THE INVENTION

The general aim of the present invention is to provide new and improved hydraulic apparatus in which noise resulting from pulsations of the cylinder blocks is significantly reduced thereby to enable the apparatus to operate more quietly and with greater efficiency.

A more detailed object of the invention is to achieve the foregoing by locating two rotating cylinder blocks on opposite sides of a rotationally stationary valve block and by tying the cylinder blocks together axially so that any pulsation tending to unseat one cylinder block from the valve block is transmitted to and tends to seat the other cylinder block against the valve block. In this way, the pulsations tend to balance one another to reduce noise otherwise resulting from the pulsations.

An important object of the invention is to tie the cylinder blocks rigidly to one another and to the valve block while enabling the axial clearance between the cylinder blocks and the valve block to be precisely set during assembly and then to be automatically adjusted during operation in order to compensate for fluctuations in working pressure.

Still another object is to effect automatic adjustment of the axial clearance by provision of a unique axially expandible ring which not only serves to allow pressure-controlled axial adjustment of the cylinder blocks but also serves as a fluid-tight seal.

A further object is to incorporate the novel features of the invention into a pump/motor combination forming a quiet hydrostatic drive and also into a pump/pump combination forming a quiet hydraulic pump.

These and other objects and advantages of the invention will become more apparent from the following detailed description when taken in conjunction with the accompanying drawings.

DETAILED DESCRIPTION OF THE PREFERRED EMBODIMENTS

Figure 1:
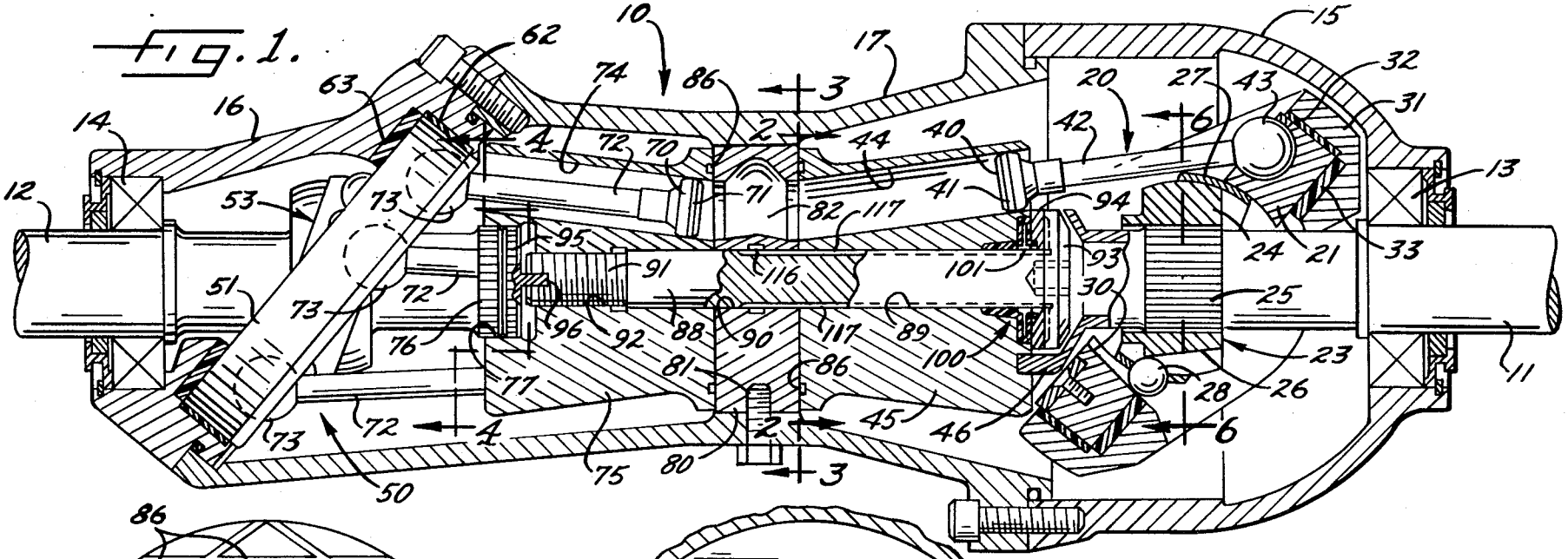
FIG. 1 is a cross-sectional view taken axially through one embodiment of a quiet hydrostatic drive incorporating the unique features of the present invention.
Figure 2:
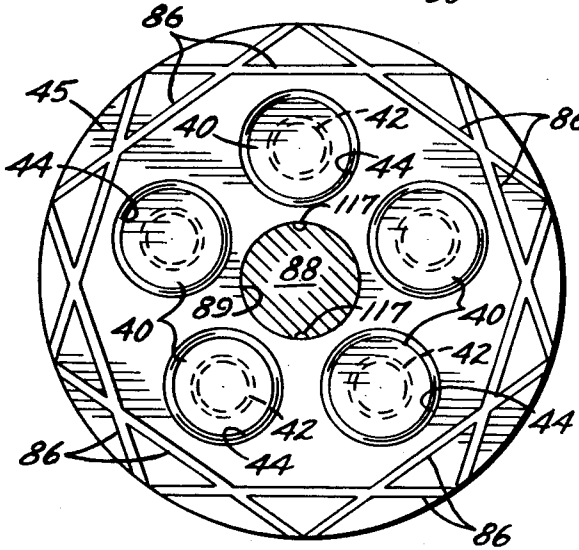
FIG. 2 is a cross-section taken substantially along the line 2—2 of FIG. 1.

Hydraulic apparatus incorporating the features of the present invention is shown in FIGS. 1 to 6 as being embodied in a hydrostatic drive 10 for transmitting torque from a power-driven rotatable input shaft 11 to a rotatable output shaft 12. The hydrostatic drive may be used as a constant speed drive to rotate the output shaft at a fixed speed regardless of the speed of the input shaft. Alternatively, the hydrostatic drive may be used as a variable speed transmission to cause the output shaft to rotate at various speed ratios relative to the input shaft. In the present instance, the drive is shown as being incorporated in a variable speed transmission.

The input and output shafts 11 and 12 are rotatably journaled by bearings 13 and 14, respectively, supported by end bells 15 and 16 secured to opposite ends of a sealed casing 17 adapted to hold hydraulic oil or other pressure fluid. The input shaft drives a variable displacement pump 20 which herein is of the axial piston type having an annular swash plate 21 adapted to be tilted to different angles to change the displacement of the pump. A constant velocity universal joint 23 connects the input shaft 11 to the swash plate 21 to cause the shaft to rotate the swash plate while enabling the swash plate to be tilted clockwise and counterclockwise relative to the shaft to any angle between forty and ninety degrees.

Figure 6:
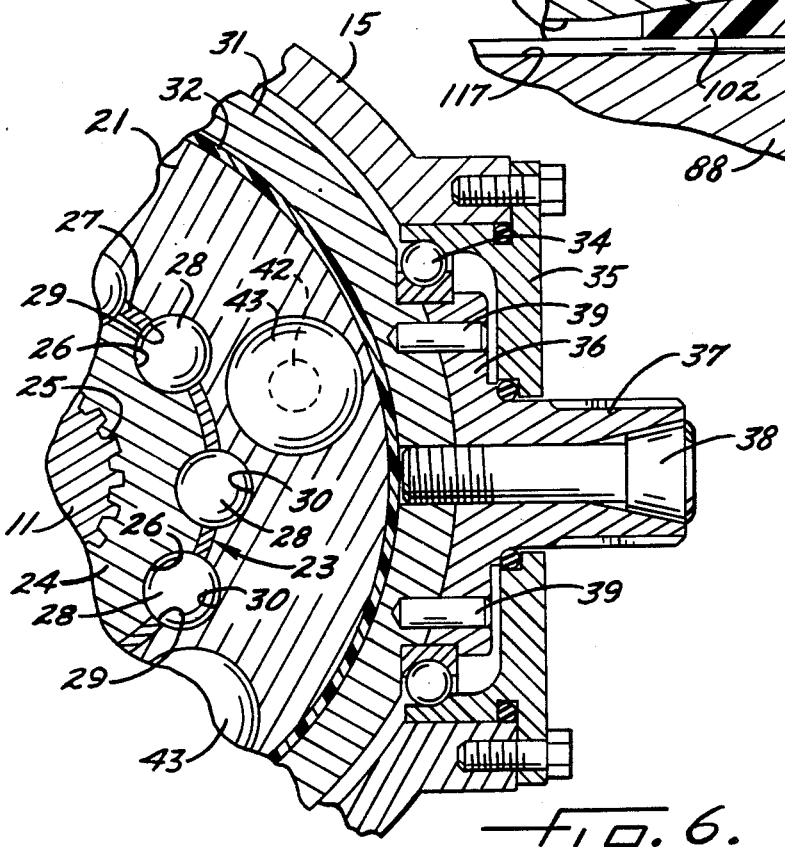
FIG. 6 is an enlarged fragmentary cross-section taken substantially along the line 6—6 of FIG. 1 but as would be seen with the swash plate of the pump at a ninety degree angle relative to the input shaft.

As shown in FIGS. 1 and 6, the universal joint 23 comprises an inner ring 24 rigidly connected to a splined portion 25 of the input shaft 11 and formed with a series of angularly spaced and axially extending grooves 26 in its outer periphery, the bottoms of the grooves being inclined at an angle between five and eight degrees. The outer peripheral surface of the inner ring 24 is spherical and supports a ring-like cage 27 for back and forth rocking. Balls 28 are captivated in angularly spaced holes 29 (FIG. 6) in the cage 27, ride in the grooves 26 in the ring 24 and also ride in angularly spaced and axially extending grooves 30 formed in the inner periphery of the swash plate 21 at the same angle as the grooves 26. Thus, the balls 28 coact with the grooves 26 and 30 to form a relatively stiff and anti-backlash torque coupling between the inner ring 24 and the swash plate 21 and coact with the cage 27 to permit the swash plate to rock back and forth on the ring.

The swash plate 21 is rotatably supported in a dish-shaped housing 31 (FIGS. 1 and 6) by a Teflon ring 32 and by a Teflon thrust washer 33. As shown in FIG. 6, a bearing 34 supports the swash plate housing 31 in a cap 35 secured to the end bell 15, the bearing permitting the housing to turn about an axis extending perpendicular to the axis of the input shaft 11. A control member 36 with an outwardly extending rod 37 is rotatably supported by the bearing 34 and the cap 35 to turn about the axis of the bearing and is connected rigidly to the swash plate housing 31 by a screw 38 and by a pair of roll pins 39. The outer end portion of the rod is splined and is adapted to be coupled to a rotary actuator (not shown). When the rod is turned, the swash plate housing 31 and the swash plate 21 are turned about the axis of the bearing 34 to change the tilt angle of the swash plate relative to the input shaft 11.

During rotation of the inclined swash plate 21 by the input shaft 11, pistons 40 (FIGS. 1 and 2) are reciprocated back and forth and act to pressurize low pressure charge oil which is supplied to the transmission 10 by a charge pump (not shown). In the present instance, there are five angularly spaced pistons and each includes a spherical piston ring 41 (FIG. 1). Extending rearwardly from each piston is an elongated piston rod 42 whose rear end is connected to the swash plate 21 by a universal ball-and-socket coupling as indicated at 43. By virtue of such couplings, the pistons may be reciprocated along fixed paths regardless of the angle of the swash plate.

The pistons 40 are supported to reciprocate within cylinders 44 (FIGS. 1 and 2) formed in a pump cylinder block 45 which is adapted to rotate within the casing 17 about the axis of the input shaft 11. As the swash plate rotates and reciprocates the pistons, a toothed coupling 46 between the input shaft and the cylinder block causes the latter to rotate in unison with the swash plate. For ease and simplicity of manufacture, the cylinders 44 are defined by forwardly converging straight-through bores which are formed simply by drilling through the cylinder block 45 from end-to-end at an angle of about ten degrees.

When the swash plate 21 is in its fully tilted position shown in FIG. 1, the pistons 40 are reciprocated through their maximum stroke during rotation of the swash plate and the cylinder block 45. As each piston is retracted through its intake stroke, its cylinder 44 is filled with low pressure oil. Such oil is pressurized as the piston advances through its power stroke and is delivered at high pressure out of the forward end of the cylinder. As the piston is tilted counterclockwise from the position shown in FIG. 1, the stroke of the pistons is proportionately shortened and the volume of pressurized oil displaced by the pistons is proportionately reduced until the swash plate reaches ninety degrees, at which time the pistons simply rotate the cylinder block without reciprocating therein and without displacing oil.

The high pressure oil delivered from the cylinders 44 is used to actuate a hydraulic motor 50 which serves to rotate the output shaft 12. Herein, the motor 50 is virtually identical in construction to the pump 20 except that the motor is a fixed displacement unit. Thus, the motor includes a swash plate 51 inclined at a fixed angle of forty degrees and connected to the output shaft 12 by a constant velocity universal joint 53 which is identical to the joint 23. A Teflon ring 62 and a Teflon thrust disc 63 support the swash plate for rotation within a dish-shaped cavity formed in the end bell 16. Five angularly spaced pistons 70 with spherical piston rings 71 and elongated rods 72 are adapted to reciprocate in straight-through cylinders 74 formed in a cylinder block 75 and are connected to the swash plate 51 by ball-and-socket couplings 73. The rear end of the output shaft 12 is formed with a splined portion 76 which is fitted into a splined bore 77 in the outboard end portion of the motor cylinder block 75 to establish a rigid coupling between the output shaft and the motor cylinder block.

When the swash plate 21 of the pump 20 is rotated clockwise and is tilted as shown in FIG. 1, movement of the pump pistons 40 through their power strokes delivers oil at high pressure to the cylinders 74 of the motor cylinder block 75 and causes the motor pistons 70 to advance. As a result, the motor swash plate 51 is rotated clockwise and acts through the universal joint 53 to effect clockwise rotation of the output shaft 12. During each revolution of the motor swash plate 51, each piston 70 is pushed rearwardly and exhausts the oil from its respective cylinder 74.

The motor pistons 70 are reciprocated through their maximum stroke and effect clockwise rotation of the output shaft 12 at maximum speed relative to the clockwise rotational speed of the input shaft 11 when the pump swash plate 21 is in its fully inclined position shown in FIG. 1. As the pump swash plate 21 is tilted counterclockwise, the displacement of the pump pistons 40 is proportionately reduced so as to reduce the speed of the output shaft relative to the speed of the input shaft. The output shaft stops rotating when the pump swash plate 21 reaches the ninety degree position and, if the swash plate is tilted counterclockwise beyond that position, the direction of rotation of the output shaft relative to the input shaft is reversed.

To control the flow of oil to and from the cylinders 44 and 74, a rotationally stationary valve block 80 (FIGS. 1 and 3) is located between and is seated against the opposing inboard ends or faces of the cylinder blocks 45 and 75. The valve block is anchored rigidly within the casing 17 by screws 81, one of which is shown in FIG. 1.

Figure 3:
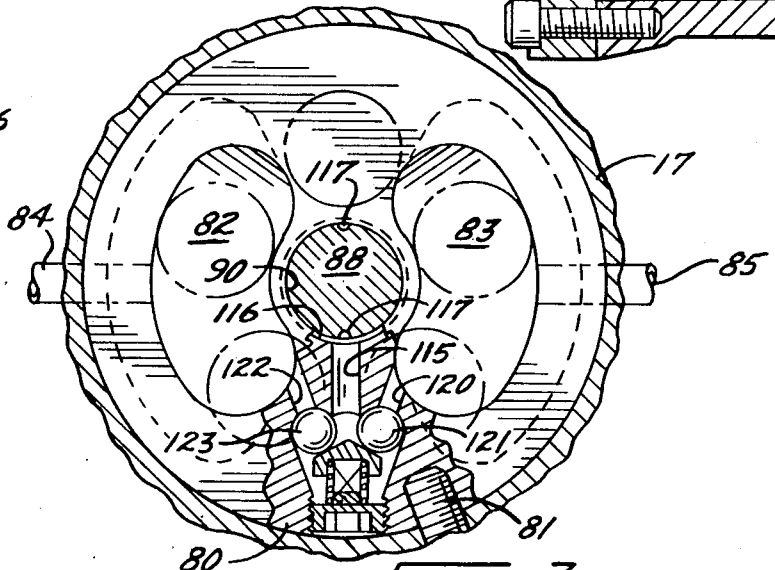
FIG. 3 is a fragmentary cross-section taken substantially along the line 3—3 of FIG. 1.
Figure 4:
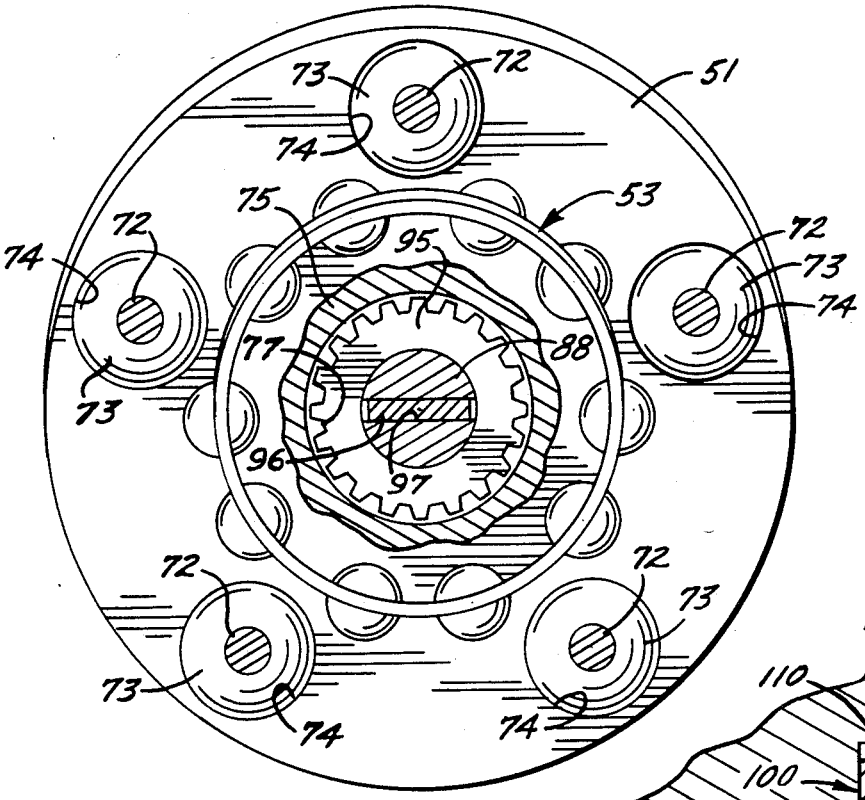
FIG. 4 is an enlarged fragmentary cross-section taken substantially along the line 4—4 of FIG. 1.

As shown in FIG. 3, two generally kidney-shaped ports 82 and 83 are formed through the valve block 80 in angularly spaced relation with one another. When the pump swash plate 21 is positioned as shown in FIG. 1 and is rotated clockwise, the port 82 communicates with a line 84 leading to the charge pump and serving to deliver low pressure charge oil to the valve block. An additional line 85 communicates with the port 83 and exhausts excess low pressure oil to the reservoir of the charge pump. If the swash plate 21 is tilted counterclockwise beyond the ninety degree position, a valve (not shown) is shifted and causes the ports 82 and 83 to communicate with the lines 85 and 84, respectively.

The inboard faces of the cylinder blocks 45 and 75 are tightly seated and sealed against opposing faces of the valve block 80 but with rotatable clearance permitting the cylinder blocks to rotate relative to the valve block. As the cylinder blocks rotate, the changing angular relationship between the cylinders 44 and 45 and the ports 82 and 83 causes oil to flow into and out of the cylinders in proper timed relationship with rotation of the cylinder blocks. The valve block enables oil delivered to the pump cylinders 44 to be pressurized during the power stroke of the pump pistons 40, enables such oil to be delivered under high pressure to the motor cylinders 74 and enables the oil to be exhausted from the latter cylinders during the return stroke of the motor pistons 70. Pressure relief grooves 86 (FIG. 2) are formed in the inboard face of each cylinder block to enable the escape of excess pressure that might build up between that face and the opposing face of the valve block 80. In the present instance, the face of each cylinder block is formed with ten pressure relief grooves arranged in the form of two equilateral pentagons.

As the cylinder blocks 45 and 75 rotate, different areas at the interface of the valve block 80 with each cylinder block are subjected to fluctuating high and low pressures. Such pressure fluctuations tend to cause the cylinder blocks to pulsate toward and away from the valve block. The pulsations, and particularly those imparted to the pump cylinder block 45, tend to cause the transmission 10 to be noisy and impair its efficiency.

In accordance with the present invention, the two cylinder blocks 45 and 75 are uniquely tied together in such a manner that any movement tending to unseat one cylinder block from the valve block 80 tends to seat the other cylinder block against the valve block. In this way, the pulsations resulting from fluctuating high and low pressures are dampened to enable the transmission 10 to run quieter, more smoothly and with better efficiency.

More specifically, the cylinder blocks 45 and 75 are tied together by an elongated rigid rod 88 whose axis coincides with the axes of the shafts 11 and 12. The rod extends rotatably through a bore 89 in the center of the pump cylinder block 45 and through a bore 90 in the center of the valve block 80. The forward end portion of the tie rod is threaded as indicated at 91 and is threaded into a tapped bore 92 formed in the motor cylinder block 75. Thus, the tie rod rotates with the motor cylinder block 75.

Secured rigidly to the forward end of the tie rod 80 is an enlarged abutment or head 93 (FIGS. 1 and 5) which bears against a bronze thrust washer 94. The latter is rotatable with respect to the tie rod and bears against the outboard face of the pump cylinder block 45.

Thus, it will be apparent that the rod 88 ties the cylinder blocks 45 and 75 to one another and holds the inboard faces of the cylinder blocks against the opposing faces of the valve block 80. By turning the rod relative to the blocks, the rod acts as a bolt and thus the rod may be turned to initially establish or adjust the axial valve clearance between the cylinder blocks and the valve block by either drawing the cylinder blocks toward the valve block or forcing the cylinder blocks away from the valve block. Once the initial axial clearance has been properly established, the rod is locked against rotation relative to the motor cylinder block 75. For this purpose, provision is made of a locking disc 95 (FIGS. 1 and 4) formed with a serrated periphery and with an axially projecting tongue 96. Once the rod 88 has been threadably tightened in the tapped bore 92, the disc 95 is placed in the splined bore 77 with the locking tongue 96 projecting into a slot 97 (FIG. 4) formed in the forward end of the rod. The splines of the bore 77 and the serrations of the disc 95 enable the disc to be turned to orient the tongue 96 angularly with the slot 97 and then lock the disc angularly in the bore after the tongue has been inserted axially into the slot.

With the foregoing arrangement, any force tending to shift the pump cylinder block 45 axially away from the valve block 80 is transmitted to the pump motor block 75 by the tie rod 88 and tends to shift the pump motor block toward the valve block. By the same token, any force tending to shift the motor cylinder block 75 axially away from the valve block 80 acts through the rod 88 and tends to draw the pump cylinder block 45 toward the valve block. Accordingly, any force tending to unseat one cylinder block from the valve block tends to seat the other cylinder block more tightly against the valve block. In this way, pulsations otherwise resulting from pressure fluctuations are dampened since the two cylinder blocks are tied together and since the valve block serves as a central anchor for the cylinder blocks. The transmission 10 thus produces less noise, runs more smoothly and operates with greater efficiency.

Further in accordance with the invention, provision is made to automatically adjust the sealing force and the axial valve clearance between the cylinder blocks 45 and 85 and the valve block 80 when the working pressure of the transmission 10 changes. When the working pressure is high and is tending to act against a greater area of the blocks, the force tending to draw the blocks together is automatically increased so as to balance the higher working pressure. At low working pressures, the force tending to draw the blocks together is automatically reduced so as to reduce the friction and wear at the interfaces of the blocks.

Figure 5:
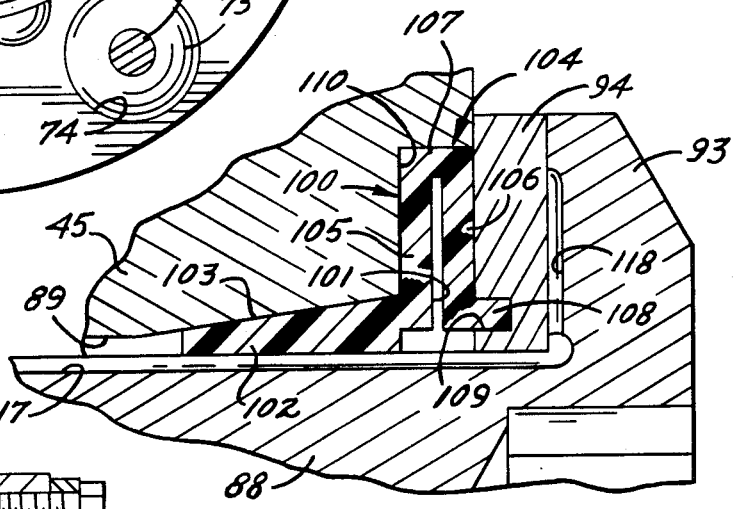
FIG. 5 is an enlarged view of certain parts shown in FIG. 1.

In large, the foregoing is achieved through the provision of (FIGS. 1 and 5) a unique sealing ring or diaphragm 100 which defines a sealed pressure chamber 101 causing the working pressure to force both cylinder blocks 45 and 75 toward the valve block 80 when the working pressure is increased. As shown in FIG. 5, the diaphragm is one one-piece construction and preferably is made of a wear resistant and resiliently yieldable material such as Teflon. The diaphragm is formed with a sleeve 102 whose inner wall defines a cylindrical bearing surface which rotatably receives the tie rod 88. The outer surface of the sleeve is tapered as indicated at 103 and is pressed tightly with a fluid-tight seal into a correspondingly tapered portion of the bore 89 in the pump cylinder block 45.

Located at the rear end of the sleeve 102 is a radially extending disc 104 which is defined by a radially extending annular flange 105 formed integrally with the rear end of the sleeve, by a second radially extending annular flange 106 and by a radially extending bridge portion 107 formed integrally with the outer ends of the two flanges 105 and 106. An axially extending annular flange 108 is formed integrally with the inner end portion of the flange 106 and is seated with a fluid-tight fit in an annular groove 109 formed in the forward face of the thrust washer 94. The radial flange 106 bears against the foward face of the thrust washer while the radial flange 105 bears against the axially facing wall of a counterbore 110 formed in the forward end of the pump cylinder block 45 and receiving the flanges 105 and 106.

The pressure chamber 101 of the diaphragm 100 is formed simply by grooving the disc 104 so as to cause the initially solid disc to be formed with the two axially spaced radial flanges 105 and 106 and with the bridge portion 107. Simply by controlling the depth of the groove, the effective area of the pressure chamber 101 can be accurately established to arrive at the proper area necessary to coact with the working pressure and develop the proper force for pressure-balancing the cylinder blocks 45 and 75 against the valve block 80.

In this specific instance, working pressure is transmitted to the pressure chamber 101 of the diaphragm 100 by way of a radially extending passage 115 (FIG. 3) formed in the valve block 80 and establishing communication between a selected one of the ports 82 or 83 and an annular groove 116 (FIG. 1) formed in the wall of the bore 90 of the valve block 80. Two angularly spaced grooves 117 (FIGS. 1, 3 and 5) in the tie rod 88 communicate with the groove 116 and extend axially along the tie rod to and beyond the diaphragm 100. The forward ends of the grooves 117 communicate with a radial pocket 118 (FIG. 5) in the rear face of the head 93 to deliver oil to the interface of the head and the thrust washer 94 for lubricating purposes.

When the pump swash plate 21 is tilted as shown in FIG. 1 and is rotated clockwise, oil at working pressure is delivered to the pressure chamber 101 of the diaphragm 100 from the port 83 by way of a passage 120 (FIG. 3) and a check valve 121 in the valve block 80 and then via the passage 115, the groove 116 and the grooves 117. Such pressure acts against the flange 105 of the diaphragm 100 to force the pump cylinder block 45 directly toward the valve block 80. At the same time, the pressure acts against the flange 106, the washer 94 and the head 93 and acts through the tie rod 88 to draw the motor cylinder block 75 toward the valve block. If the working pressure increases, the flanges 105 and 106 flex away from one another (by a few ten thousandths of an inch at most) to enable the pressure to force the blocks together even more tightly. This offsets the added area at the interfaces of the blocks against which the high pressure acts and maintains the necessary valve clearance between the blocks. When the working pressure decreases, the reduced pressure in the chamber 101 enables the flanges 105 and 106 to relax slightly and reduce the force between the blocks. It has been found that the effective area of the pressure chamber 101 of the diaphragm 100 should be such that the pressure acting in the pressure chamber creates a force which is approximately five percent greater than the force created as a result of the working pressure acting against and tending to separate the blocks.

If the pump swash plate 21 is tilted counterclockwise from the position shown in FIG. 1, oil at working pressure from the port 82 is transmitted to the passage 115 and then to the pressure chamber 101 by way of a passage 122 (FIG. 3) and a check valve 123 in the valve block 80. The pressure chamber 101 also communicates with the port 82 if the pump swash plate 21 is positioned as shown in FIG. 1 and the input shaft 11 is rotated in a counterclockwise direction.

Figure 7:
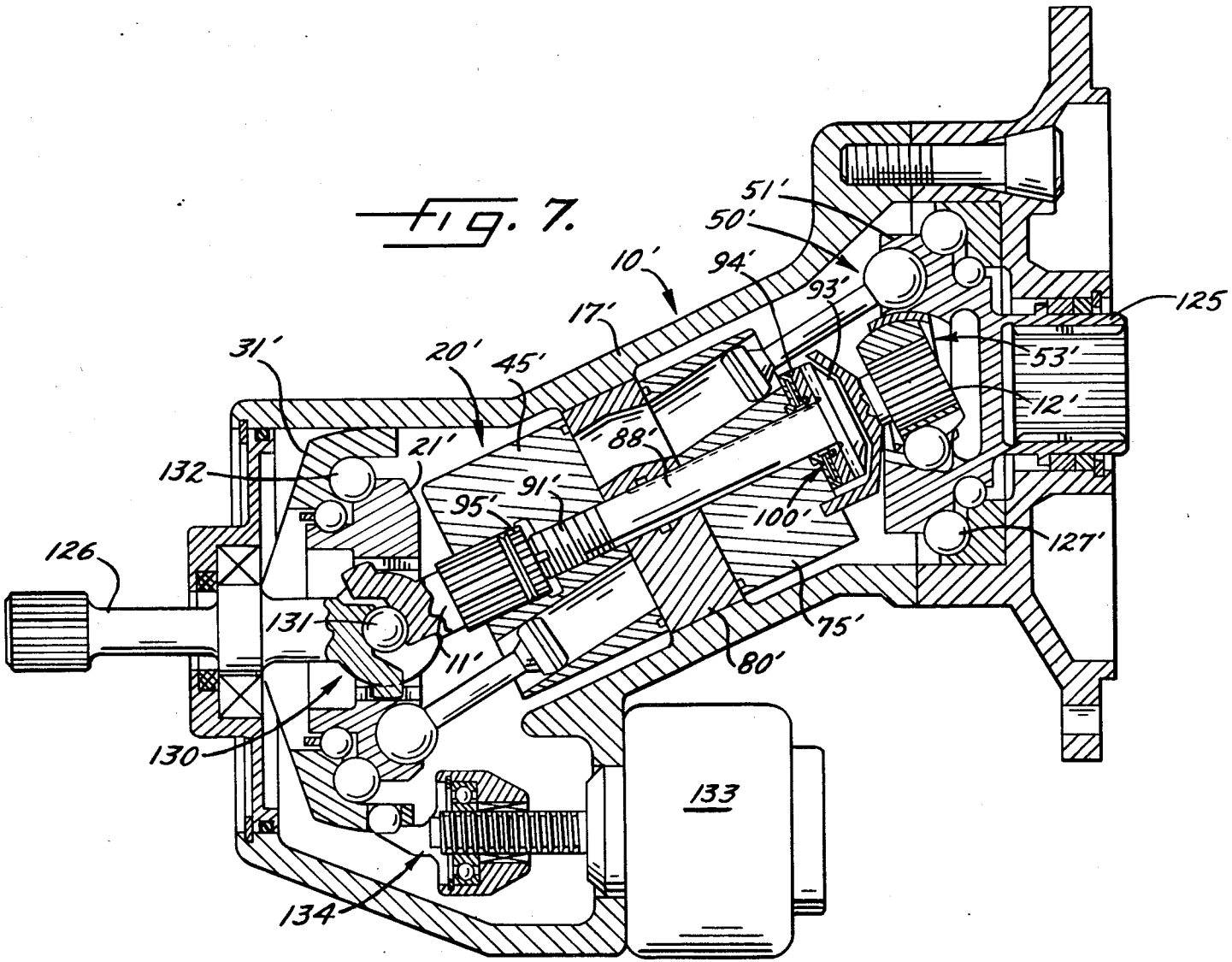
FIG. 7 is a view similar to FIG. 1 but shows another embodiment of a hydrostatic drive incorporating the features of the invention.

Another embodiment of a drive 10' incorporating the features of the invention is shown in FIG. 7 and, in this instance, is used to drive an output member 125 at a constant speed regardless of the speed of an input member 126. The drive 10' includes a variable displacement pump 20' with an adjustable swash plate 21' and a rotatable cylinder block 45'; includes a fixed displacement motor 50' with a fixed swash plate 51' and a rotatable cylinder block 75'; and includes a rotationally stationary valve block 80' disposed between the two cylinder blocks. The two cylinder blocks are tied together by a rod 88' which is identical to the rod 88 but which is turned end-for-end so that its head 93' is located adjacent the motor cylinder block 75' while its threaded end portion 91' is screwed into the pump cylinder block 45'. The diaphragm 100' is located adjacent the head 93' and is positioned between the motor cylinder block 75' and a thrust washer 94'.

The swash plate 51' of the motor 50' is coaxial with the output member 125 and is journaled in the casing 17' by a bearing 127. A constant velocity universal joint 53' identical to the joint 53 connects the swash plate 51' to an output shaft 12', the latter being disposed at an angle of about twenty-five degrees relative to the output member 125.

The input member 126 extends parallel to and is offset from the output member 125 and is connected to an input shaft 11' by a toothed universal joint 130 (FIG. 7). The pump swash plate 21' is pivotally connected at 131 to the universal joint to rock about an axis extending perpendicular to the shaft 11', the pump swash plate being journaled in a housing 31' by a bearing 132. A servo actuator 133 senses the speed of the input member 126 and advances or retracts a control member 134 to rock the swash plate 31' about the pivot 131 and maintain the swash plate at an angle causing the speed of the output member 125 to remain constant regardless of the speed of the input member 126. Because the input and output members are in parallel offset relation, the torque loads exerted on the universal joints 53' and 130 are reduced.

Figure 8:
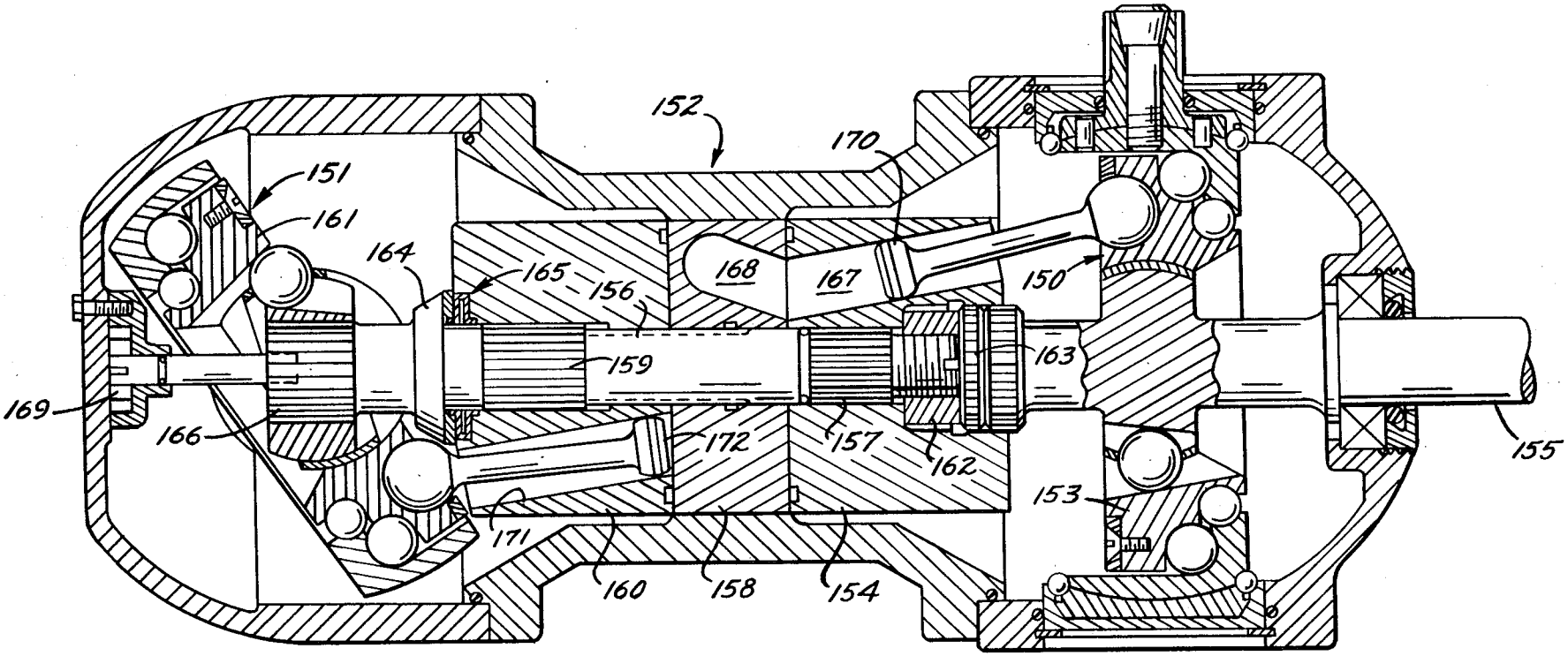
FIG. 8 is a cross-sectional view taken axially through a quiet hydraulic pump incorporating the features of the invention.

Still another embodiment of hydraulic apparatus utilizing the principles of the invention is shown in FIG. 8 and, in this instance, two swash plate pumps 150 and 151 coact to form a single pump 152 which is quiet in operation. The pump 150 includes a swash plate 153 and a cylinder block 154 adapted to be rotated by a splined input shaft 155. A tie rod 156 is splined to the cylinder block 154 at 157, extends rotatably through a valve block 158 and is splined at 159 to a cylinder block 160 for the pump 151, the latter having a swash plate 161. One end of the tie rod is anchored to the block 154 by a nut 162 and a locking disc 163 while the other end of the tie rod includes a head 164 which is located adjacent a diaphragm 165 adapted to receive oil at working pressure from the valve block. A splined extension 166 of the tie rod drives the swash plate 161 of the pump 151.

Five angularly spaced cylinders 167 in the cylinder block 154 coact with appropriate ports 168 in one side of the valve block 158 to receive low pressure oil from a charge pump 169 and to effect pressurization of the oil as pistons 170 reciprocate. The cylinder block 160 is formed with five angularly spaced cylinders 171 offset angularly by thirty-six degrees from the cylinders 167 and coacting with ports (not visible) in the other side of the valve block 158, there being pistons 172 adapted to reciprocate in the cylinders 171 during rotation of the swash plate 161.

As before, the rod 156 ties the two cylinder blocks 154 and 160 together so that any force tending to unseat either cylinder block from the valve block 158 tends to seat the other cylinder block against the valve block to reduce pulsations and noise. Oil at working pressure is delivered from the valve block to the diaphragm 165 to cause the cylinder blocks to seat more tightly against the valve block when the working pressure is high and to increase the axial clearance when the working pressure is low. This tying togther of two pumps 150 and 151 enables the overall pumping unit 152 to operate quietly and efficiently. Because the cylinders 167 of the cylinder block 154 are offset by thirty-six degrees from the cylinders 171 of the cylinder block 160, one piston 170, 172 in one block is at zero pumping velocity while another piston in the other block is at maximum pumping velocity.

I claim:

1. Hydraulic apparatus adapted to pressurize oil and comprising first and second rotatable swash plates, first and second rotatable cylinder blocks having opposing faces each formed with a set of angularly spaced cylinders, a first set of angularly spaced pistons connected to rotate with said first swash plate and said first cylinder block and supported to reciprocate in the cylinders of said first cylinder block, a second set of angularly spaced pistons connected to rotate with said second swash plate and said second cylinder block and supported to reciprocate in the cylinders of said second cylinder block, a rotationally stationary valve block disposed between and seated against opposing faces of said cylinder blocks for controlling the flow of oil to and from the cylinders of each cylinder block during rotation of the cylinder blocks, said cylinder blocks tending to move axially toward and away from said valve block as said oil is pressurized to a working pressure, a rod tying said cylinder blocks axially together and transmitting the axial movement of each cylinder block to the other cylinder block whereby a force tending to unseat one cylinder block from said valve block tends to seat the other cylinder block against said valve block, and pressure-actuated means comprising an annular diaphragm encircling said rod and made of resiliently yieldable material, said diaphragm having a groove defining a pressure chamber, means for admitting oil at working pressure into said pressure chamber, said diaphragm acting between said rod and one of said cylinder blocks and responsive to the pressure in said chamber to force said cylinder blocks toward said valve block when such pressure increases and to allow said cylinder blocks to move away from said valve block when such pressure decreases.

2. Hydraulic apparatus as defined in claim 1 in which said first swash plate, said first cylinder block and said first set of pistons constitute components of a hydraulic pump, an input shaft connected to rotate said first swash plate to cause said pistons to reciprocate in the cylinders of said first cylinder block and pressurize said oil; said second swash plate, said second cylinder block and said second set of pistons constituting components of a hydraulic motor, the cylinders of said second cylinder block communicating with the cylinders of said first cylinder block by way of said valve block whereby oil pressurized by said first set of pistons causes said second set of pistons to reciprocate in the cylinders of said second cylinder block, and an output shaft connected to said second swash plate to rotate in response to reciprocation of said second set of pistons.

3. Hydraulic apparatus as defined in claim 1 in which said first swash plate, said first cylinder block and said first set of pistons constitute components of a first hydraulic pump, said second swash plate, said second cylinder block and said second set of pistons constituting components of a second hydraulic pump, and means connected to rotate each of said swash plates to cause each set of pistons to reciprocate in the cylinders of the respective cylinder block and pressurize oil admitted into said cylinders.

4. Hydraulic apparatus as defined in claim 1 in which said rod extends between said cylinder blocks and through said valve block, an abutment on said rod and engageable with one of said cylinder blocks to hold such cylinder block against said valve block, at least one of said rod and said abutment being manually adjustable to enable the axial clearance between said cylinder blocks and said valve block to be adjusted manually.

5. Hydraulic apparatus as defined in claim 4 in which said diaphragm located between said abutment and the adjacent one of said cylinder blocks.

6. Hydraulic apparatus as defined in claim 5 in which one end of said diaphragm is connected to said one cylinder block, the other end of said diaphragm being connected to said abutment.

7. Hydraulic apparatus adapted to pressurize oil and comprising first and second rotatable swash plates, first and second rotatable cylinder blocks having opposing faces each formed with a set of angularly spaced cylinders, a first set of angularly spaced pistons connected to rotate with said first swash plate and said first cylinder block and supported to reciprocate in the cylinders of said first cylinder block, a second set of angularly spaced pistons connected to rotate with said second swash plate and said second cylinder block and supported to reciprocate in the cylinders of said second cylinder block, and a rotationally stationary valve block disposed between and seated against opposing faces of said cylinder blocks for controlling the flow of oil to and from the cylinders of each cylinder block as the cylinder blocks rotate, said cylinder blocks tending to move axially toward and away from said valve block as said oil is prssurized to a working pressure, a rod extending between said cylinder blocks and through said valve block, said rod being connected axially and substantially rigidly to said cylinder blocks and transmitting the axial movement of each cylinder block to the other cylinder blcok whereby a force tending to unseat one cylinder block from said valve block tends to seat the other cylinder block against said valve block, and means for enabling the axial clearance of the connection between said rod and said cylinder blocks to be changed automatically, said means comprising an annular diaphragm encircling said rod and made of resiliently yieldable material, said diaphragm having a groove defining a pressure chamber, means for admitting oil at working pressure into said pressure chamber, said diaphragm being responsive to the pressure in said chamber to reduce said clearance and cause said cylinder blocks to seat more tightly against said valve block when such pressure increases and to increase said clearance and enable said cylinder blocks to seat less tightly against said valve block when such pressure decreases.

8. Hydraulic apparatus as defined in claim 7 further including means on said rod and enabling the axial clearance between said cylinder blocks and said valve block to be adjusted manually.

9. Hydraulic apparatus adapted to pressurize oil and comprising first and second rotatable swash plates, first and second rotatable cylinder blocks having opposing inboard faces each formed with a set of angularly spaced cylinders, a first set of angularly spaced pistons connected to rotate with said first swash plate and said first cylinder block and supported to reciprocate in the cylinders of said first cylinder block, a second set of angularly spaced pistons connected to rotate with said second swash plate and said second cylinder block and supported to reciprocate in the cylinders of said second cylinder block, and a rotationally stationary valve block disposed between and seated against opposing faces of said cylinder blocks for controlling the flow of oil to and from the cylinders of each cylinder blocks tending to move axially toward and away from said valve block as said oil is pressurized to a working pressure, a rod extending between said cylinder blocks and through said valve block and axially rigid with one of said cylinder blocks, an axially facing abutment on said rod and engageable with an outboard facing portion of the other of said cylinder blocks, said rod and said abutment coacting to transmit the axial movement of each cylinder block to the other cylinder block whereby a force tending to unseat one cylinder block from said valve block tends to seat the other cylinder block against said valve block, at least one of said abutment and said rod being manually adjustable in an axial direction to enable the axial clearance between said cylinder blocks and said valve block to be selectively adjusted, and means for enabling the axial clearance between said cylinder blocks and said valve blocks to change automatically, said means comprising a pressure chamber located between said abutment and said other cylinder block, said pressure chamber being defined within an annular diaphragm made of resiliently yieldable material and encircling said rod, one end of said diaphragm being connected to said other cylinder block, the other end of said diaphragm being connected to said abutment, and means for admitting oil at working pressure into said pressure chamber whereby said cylinder blocks are forced toward said valve block when the working pressure increases and are allowed to move away from said valve block when the working pressure decreases.

10. Hydraulic apparatus adapted to pressurize oil and comprising first and second rotatable swash plates, first and second rotatable cylinder blocks having opposing faces each formed with a set of angularly spaced cylinders, a first set of angularly spaced pistons connected to rotate with said first swash plate and said first cylinder block and supported to reciprocate in the cylinders of said first cylinder block, a second set of angularly spaced pistons connected to rotate with said second swash plate and said second cylinder block and supported to reciprocate in the cylinders of said second cylinder block, a rotationally stationary valve block disposed between and seated against opposing faces of said cylinder blocks for controlling the flow of oil to and from the cylinders of each cylinder block during rotation of the cylinder blcoks, said cylinder blocks tending to move axially toward and away from said valve block as said oil is pressurized to a working pressure, means tying said cylinder blocks axially together and transmitting the axial movement of each cylinder block to the other cylinder block whereby a force tending to unseat one cylinder block from said valve block tends to seat the other cylinder block against said valve block, said tying means comprising a rod extending between said cylinder blocks and through said valve block, an abutment on said rod and engageable with one of said cylinder blocks to hold such cylinder block against said valve block, at least one of said rod and said abutment being manually adjustable to enable the axial clearance between said cylinder blocks and said valve block to be adjusted manually, pressure-actuated means acting between said tying means and one of said cylinder blocks and responsive to said working pressure to force said cylinder blocks toward said valve block when the working pressure increases and to allow said cylinder blocks to move away from said valve block when the working pressure decreases, said pressure-actuated means comprising a pressure chamber located between said abutment and the adjacent one of said cylinder blocks, said pressure chamber being defined within an annular diaphragm made of resiliently yieldable material and encircling said rod, one end of said diaphragm being connected to said one cylinder block, the other end of said diaphragm being connected to said abutment and means for admitting oil at working pressure into said pressure chamber.

11. Apparatus for use with pressure fluid and comprising a rotatable swash plate, a rotatable cylinder block having first and second end faces and formed with a set of angularly spaced cylinder bores, each of said cylinder bores being of circular cross-section and extending through said cylinder block between the end faces thereof, a set of angularly spaced pistons connected to rotate with said swash plate and supported to reciprocate in said cylinder bores, said pistons also being of circular cross-section and having a diameter substantially equal to the diameter of said cylinder bores at said first end face of said cylinder block, a rotationally stationary valve block seated against said first face of said cylinder block and having generally kidney-shaped ports for controlling the flow of pressure fluid to and from said cylinder bores as said cylinder block rotates, said cylinder block tending to move axially toward and axially away from said valve block as the working pressure of the pressure fluid between the blocks decreases and increases, respectively, a rod extending between the center of said cylinder block and the center of said valve block, said rod being substantially axially rigid with one of said blocks, an axially facing abutment on said rod and engageable with an outboard facing portion of the other block, at least one of said abutment and said rod being manually adjustable in an axial direction to enable the axial clearance between said blocks to be selectively adjusted, means for enabling the axial clearance between said blocks to change automatically, said means comprising a pressure chamber located between said abutment and said other block, said pressure chamber being defined within an annular diaphragm made of resiliently yieldable material and encircling said rod, one end of said diaphragm being connected to said other block, the other end of said diaphragm being connected to said abutment, and means for admitting pressure fluid at working pressure into said pressure chamber whereby said blocks are forced together when the working pressure in said pressure chamber increases and are allowed to move away from one another when the working pressure in said pressure chamber decreases.

* * * * *